US006647888B1

(12) United States Patent
Cesaroni et al.

(10) Patent No.: US 6,647,888 B1
(45) Date of Patent: Nov. 18, 2003

(54) OXIDIZER PACKAGE FOR PROPELLANT SYSTEM FOR ROCKETS

(76) Inventors: Anthony Joseph Cesaroni, 9 Heathmore Court, Unionville, Ontario (CA), L3R 8J1; Michael J. Dennett, P.O. Box 246, Gormley, Ontario (CA), J0H 1G0; Korey R. Kline, 7290 SW. 42 St., Miami, FL (US) 33155; Kevin E. Mahaffy, AFRL/PRRM, Edwards AFB, CA (US) 93524-7190; Kevin W. Smith, 7290 SW. 42 St., Miami, FL (US) 33155

( * ) Notice: Subject to any disclaimer, the term of this patent is extended or adjusted under 35 U.S.C. 154(b) by 0 days.

(21) Appl. No.: 09/565,509

(22) Filed: May 5, 2000

Related U.S. Application Data

(60) Provisional application No. 60/161,771, filed on Oct. 27, 1999, and provisional application No. 60/132,795, filed on May 6, 1999.

(51) Int. Cl.[7] ..... C06B 45/00; C06D 5/10

(52) U.S. Cl. ..... 102/289; 102/290; 102/292

(58) Field of Search ..... 102/285, 289–290, 102/292, 374; 60/253

(56) References Cited

U.S. PATENT DOCUMENTS

| | | | | | |
|---|---|---|---|---|---|
| 3,183,665 | A | * | 5/1965 | Webb | 102/287 X |
| 3,316,718 | A | * | 5/1967 | Webb | 102/287 X |
| 3,429,265 | A | * | 2/1969 | Longwell et al. | 102/287 |
| 3,527,168 | A | * | 9/1970 | McCurdy et al. | 102/287 |
| 3,811,380 | A | * | 5/1974 | Glass | 102/49.7 |
| 3,812,671 | A | * | 5/1974 | Burr et al. | 60/39.47 |
| 4,781,117 | A | * | 11/1988 | Garnett et al. | 102/493 |
| 5,010,728 | A | * | 4/1991 | Joy | 160/39.464 |
| 5,351,619 | A | * | 10/1994 | Chan et al. | 102/289 |
| 5,579,635 | A | * | 12/1996 | Miskelly, Jr. et al. | 60/242 |
| 5,714,711 | A | * | 2/1998 | Schumacher et al. | 102/291 |
| 5,847,311 | A | * | 12/1998 | Ryder | 102/288 |
| 6,354,218 | B1 | * | 3/2002 | Weise et al. | 102/286 |

FOREIGN PATENT DOCUMENTS

CA 2243245 7/1997

OTHER PUBLICATIONS

State and Prospects of Solid Propellant Rocket Development, AIAA 92–3872 AIAA/SAE/ASME/ASEE 28$^{th}$ Joint Propulsion Conference and Exhibit, Jul. 6–8, 1992, Nashville, TN.

* cited by examiner

*Primary Examiner*—Peter A. Nelson
(74) *Attorney, Agent, or Firm*—Libert & Associates; Victor E. Libert; Frederick A. Spaeth

(57) ABSTRACT

An oxidizer package for a propellant system for a motor in which the oxidizer is separated from fuel grain, the oxidizer package comprising oxidizer material and an ignition system therefor in a wrapping or sealing material. A hybrid rocket comprising oxidizer material and fuel grain, the oxidizer material being separated from the fuel grain and being in the form of a single package or plurality of packages of oxidizer material and an ignition system therefor, said packages generally conforming to the shape of the rocket. A grid of a pyrotechnic material. A propulsion system for a hybrid rocket comprising oxidizer material in a matrix, mesh, wool, foamed metal or wires of structural or pyrotechnic material.

17 Claims, 8 Drawing Sheets

35
37

38A
35
39
34
39
38B
38C 40C
34
40B
34
40A
41
35
34
35
40D
34
41

42C
42D
42B
44
42A

42A 45C
42A

OXIDIZER PACKAGE FOR PROPELLANT SYSTEM FOR ROCKETS

CROSS REFERENCE TO RELATED APPLICATION

This application claims the benefit of U.S. provisional application Serial No. 60/132,795, filed May 6, 1999, entitled "PROPELLANT SYSTEM FOR HYBRID ROCKETS", and U.S. provisional application Serial No. 60/161,771, filed Oct. 27, 1999, entitled "OXIDIZER PACKAGE FOR PROPELLANT SYSTEM FOR ROCKETS".

FIELD OF THE INVENTION

The present invention relates to a propellant system for a hybrid rocket. In particular, the propellant system utilizes discrete oxidizer packages of oxidizer capable of being stored in the oxidizer section of the hybrid rocket. In embodiments, the present invention relates to an oxidizer package for a propellant system for a rocket, in which the package contains ampoules of compounds that enhance the performance of the propellant system. In particular, the anipoules contain oxidizer. The present invention also relates to a rocket utilizing oxidizer in the form of a plurality of such packages capable of being activated or deployed in single or multiple fashion. In particular embodiments, the present invention relates to oxidizer packages comprising oxidizer and an ancillary compound, in which a matrix of ancillary compound has the ampoules of oxidizer therein. The ancillary compound undergoes exothermic decomposition substantially without consumption of oxygen from the oxidizer.

BACKGROUND TO THE INVENTION

The following acronyms are used in this application:

| | |
|---|---|
| AP | ammonium perchlorate |
| AN | ammonium nitrate |
| ADN | ammonium dinitramide |
| BAMO/AMMO | bis-azidomethyloxetane/azidomethylmethoxetane copolymer |
| BAMO/NMMO | bis-azidomethyloxetane/nitramethylmethoxetane copolymer |
| BTTN | butanetriol trinitrate |
| GAP | glycidyl azide polymer |
| HAN | hydroxylammonium nitrate |
| HAP | hydroxylammonium perchlorate |
| HNF | hydrazinium nitroformate |
| HMX | cyclotrimethylenetrinitramine |
| HTPB | hydroxyl-terminated polybutadiene |
| NP | nitronium perchlorate |
| PBAN | polybutadiene acrylonitrile |
| PETN | pentaerythritol tetranitrate |
| TMETN | trimethylolethane trinitrate |

Hybrid propulsion systems offer numerous potential advantages over solid and/or liquid propulsion systems. Some potential advantages include high mass fraction, low cost, rapid deployment, reduced storage and transportation restrictions, throttling ability, configurable thrust and mission profiles as well as modifiable plume signatures and low temperature sensitivity. Traditionally, propulsion systems have used liquid oxidizers, which in many cases present handling and storage safety issues.

Solid propulsion systems could provide very high specific impulse by utilizing high performance oxidizers such as AND, HAP, HAN, HNF, NP and the like. Many of these oxidizers offer significant gains on performance, reduced or low toxicity and have desirable exhaust signature characteristics. However, many of these oxidizers suffer from varying degrees and forms of instability, such as photo sensitivity, shock, friction and impact sensitivity, decomposition in the presence of moisture, sensitivity to pH and incompatibility (such as hypergolic reaction) to other propellant materials. A typical example of incompatibility is reaction between HNF and curing agents used in solid propellant binder systems such as HTPB and GAP. Many difficulties have been encountered incorporating the oxidizers into propellant systems, and solutions to particular storage and stability problems often result in compromising the theoretical performance potential. For example, current techniques to synthesize HNF still produce particles with length to diameter ratios of 2:1 to 3:1 with significant variation from the mean. This seriously impacts formulation rheology and can prevent achievement of optimum solids loading, as well as aggravating friction sensitivity during mixing and casting operations.

Storing the oxidizer separately in the motor offers the ability to avoid compatibility issues between these oxidizers and common solid propellant system components and to optimize the physical and environmental requirements of the oxidizer, with the potential to improve the performance of tactical missile systems. A typical example of incompatibility is reaction between HNF and curing agents used in solid propellant binder systems such as HTPB and GAP.

Separate storage of solid and semi-solid oxidizers and expulsion systems have been proposed and demonstrated in the past. Some of the difficulties in these approaches include flow stability, concentration and distribution of oxidizer solids in carrier agents, pressurization and piping system requirements, specialized control valves and system integration. Certain examples of flowable oxidizers can behave as mono-propellants causing flame tracking and catastrophic failure in the delivery and storage systems.

Rocket motors based on gaseous and liquid oxidizers have been successfully demonstrated in the past.

SUMMARY OF THE INVENTION

A propellant system for a hybrid rocket using solid or semi-solid oxidizers has now been found, including a method of storage and deployment providing structural and operational benefits. Embodiments of the invention provide an oxidizer package for a propellant system for a rocket in which the oxidizer package comprises oxidizer and optionally ancillary compound, the ancillary compound undergoing exothermic decomposition substantially without consumption of oxygen from the oxidizer. The oxidizer may be in ampoules within the ancillary compound.

Accordingly, one aspect of the present invention provides an oxidizer package for a propellant system for a motor in which the oxidizer is separated from fuel grain, the oxidizer package comprising oxidizer material and an ignition system therefor in a wrapping or sealing material.

In preferred embodiments of the invention, the package is adapted to form a plurality of packages of oxidizer material in a stacked column.

In a further embodiment, the oxidizer packages are adapted to be separated by an inhibitor layer.

In a further embodiment, the oxidizer packages are adapted to be separated by an inhibitor layer.

In other embodiments, the packaging material is formed of material selected from polymer coated aluminum, aluminum coated with a mixture of polymer and magnesium, aluminum coated with a fluoroelastomer and magnesium, pyroalloying metal foil, and a pyrotechnic material consisting of laminates of magnesium foil and fluoropolymer, especially fluoropolymer sheet coated with magnesium or aluminum or alloys of magnesium and aluminum, nitrocellulose or double-based propellant.

In other embodiments, the ancillary compound is selected from the group consisting of a fluoropolymer, a fluoroelastomer, an energetic polymer, a non-energetic polymer, an energetic metal, a crystalline explosive, a polymerized peroxide and a double-based propellant. Preferably, the ancillary compound is a solid propellant formulated for stoichiometric oxygen balance or excess oxygen.

In further embodiments, oxidizer is separated from ancillary compound, said oxidizer being contained in ampoules within the ancillary compound. The oxidizer may be a liquid, a solid or a semi-solid material.

In additional embodiments, there is solid propellant composition formulated for at least stoichiometric oxygen balance.

The ampoules may contain carriers or performance enhancing compounds selected from the group consisting of a fluoropolymer, a fluoroelastomer, an energetic polymer, a non-energetic polymer, an energetic metal, a crystalline explosive, polymerized peroxide and a double-based propellant. The ampoule may be formed from coated aluminum, pyroalloying metal foil, or laminate or sheet of aluminum or magnesium, an energetic polymer, a non-energetic polymer, nitrocellulose and a double-based propellant, especially in which the coated aluminum is selected from polymercoated aluminum, aluminum coated with a mixture of polymer and magnesium, and aluminum coated with a fluoroelastomer and magnesium.

A further aspect of the invention provides a hybrid rocket comprising oxidizer material and fuel grain, the oxidizer material being separated from the fuel grain and being in the form of a single package or plurality of packages of oxidizer material and an ignition system therefor, the oxidizer packages generally conforming to the shape of the rocket.

Another aspect of the invention provides a grid of a pyrotechnic material, especially in which the grid is a matrix, mesh, wool, foamed metal or wires of the pyrotechnic material.

A further aspect of the invention provides a propulsion system for a hybrid rocket comprising oxidizer material in a matrix, mesh, wool, foamed metal or wires of structural or pyrotechnic material, especially in which the matrix, mesh, wool, foamed metal or wires enhance burn rate through thermal conductivity.

Another aspect of the invention provides a.propulsion system for a hybrid rocket comprising a plurality of columns of oxidizer material, the columns being supported by a grid of structural and/or pyrotechnic material, especially in which the pyrotechnic grid material is designed to burn more quickly than the oxidizer material contained therein.

BRIEF DESCRIPTION OF THE DRAWINGS

The present invention is illustrated by the embodiments shown in the drawings, in which.

DETAILED DESCRIPTION OF THE INVENTION

Reference to oxidizer or oxidizer material in the context of this description refers either to the oxidizer compound or compounds themselves, or to the oxidizer compound or compounds in combination with other materials such as may be required to effect consolidation and/or binding, to modify the combustion characteristics, to modify storage stability, to modify sensitivity, or any other modifiers necessary to achieve required performance characteristics. Nonetheless, the primary function of the oxidizer material is to supply oxidizing gases to support the combustion process of the rocket.

Figure 1:
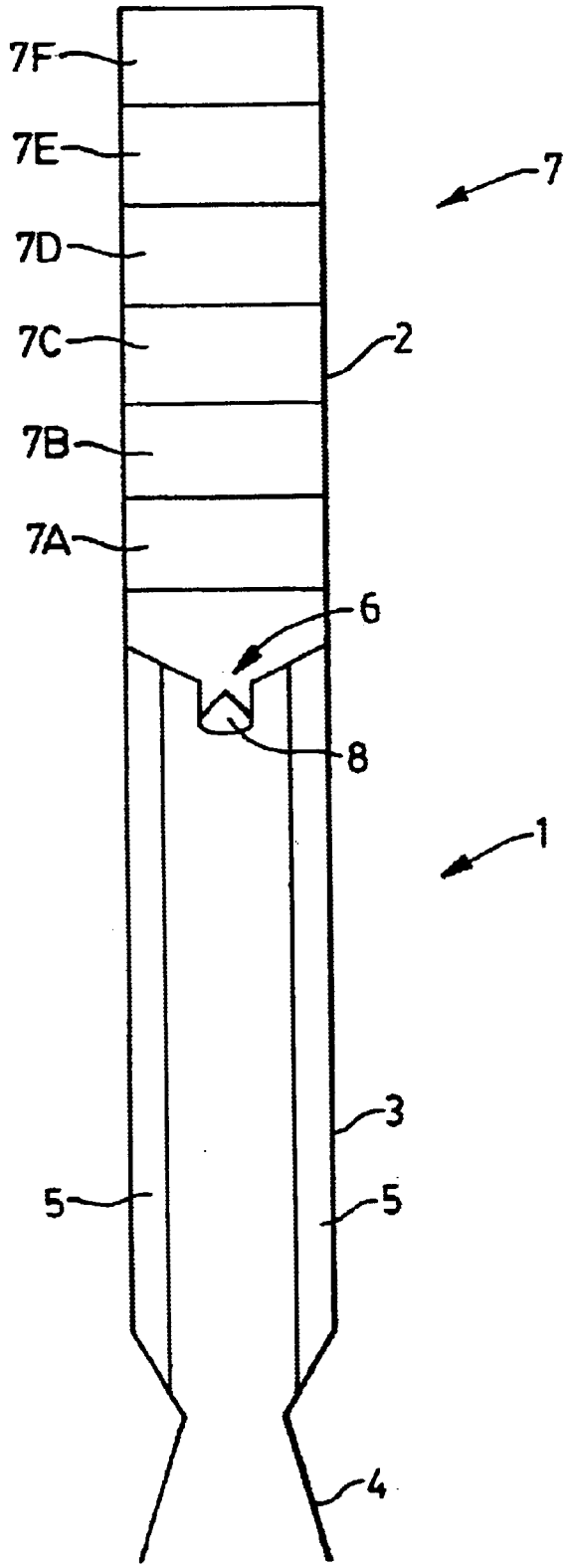
FIG. 1 is a schematic representation of a rocket of the present invention.

FIG. 1 shows an embodiment of a rocket, generally indicated by 1. Rocket 1 has oxidizer section casing 2 and fuel grain casing 3. Fuel grain casing 3 terminates in nozzle 4 and has an annular column of fuel grain 5. A wide variety of configurations of fuel grain 5 are known, particularly including star grain. Oxidizer section casing 2 and fuel grain casing 3 are separated by vent 6, which is a vent, particularly annular in design, for the passage of gases from the oxidizer section casing 2 into fuel grain casing 3.

Oxidizer section casing 2 has a plurality(of stacked oxidizer packages, indicated by 7A, 7B, 7C, 7D, 7E and 7F. It is understood that any number of oxidizer packages could be used from a single oxidizer package to a large number of oxidizer packages, and that the oxidizer packages could be of varying thickness or composition depending on the use of the rocket. It is also understood that the lowest oxidizer package, oxidizer package 7A, would have an ignition system associated therewith. It is also preferred that an inhibitor layer separates each oxidizer package and that each has a separate ignition system for controlled delivery. Oxidizer package 7A is described in greater detail below.

FIG. 1 also shows the optional vent plug 8. Vent plug 8 is located in vent 6, and is intended to ensure a build-up of pressure within the oxidizer section casing 2 to a predetermined level prior to passage of oxygen and other gases from the oxidizer section casing 2 into the fuel grain casing 3.

Figure 2:
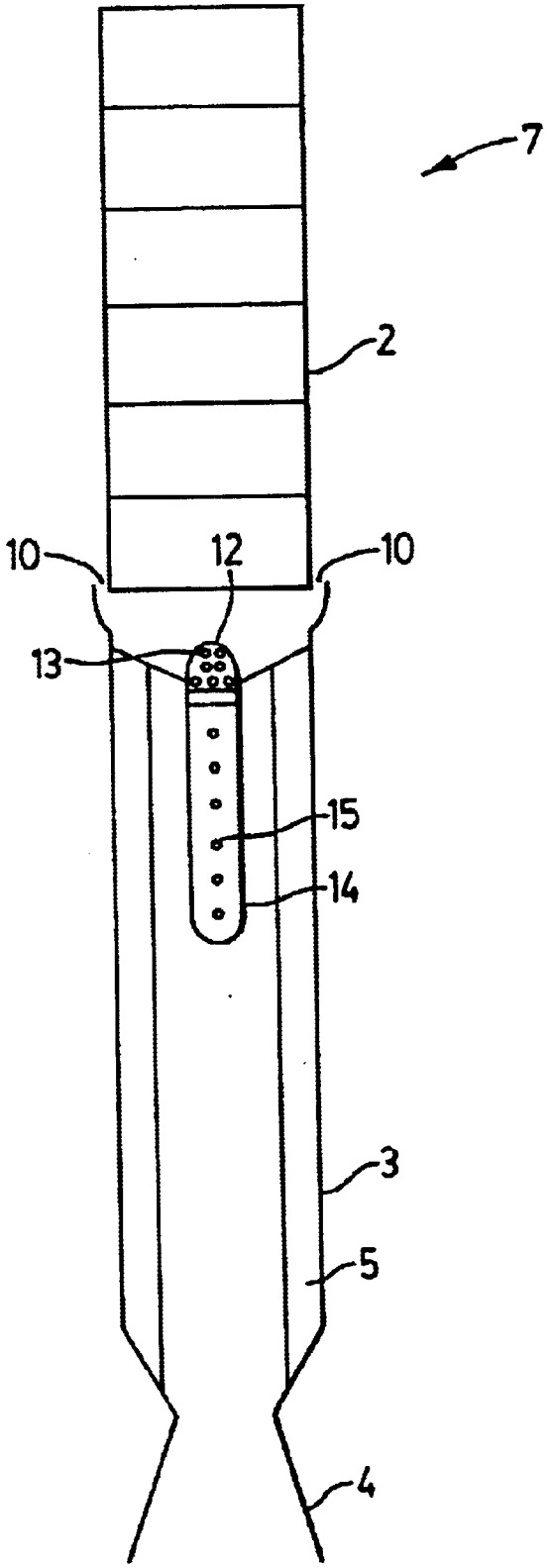
FIG. 2 is a schematic representation of another embodiment of a rocket of the present invention.

FIG. 2 shows a rocket generally as shown in FIG. 1 but having optional embodiments. The rocket of FIG. 2 has spill ports 10 and 11 shown as located on the lower part of oxidizer section casing 2. Spill ports 10 and 11 are used to permit ambient air, particularly ambient oxygen to flow into oxidizer section casing 2 and through vent 6 during use of the rocket. Such ambient oxygen would either mix with the oxidizing gases produced by combustion of the oxidizer packages, or be used alone and fed into the fuel grain casing. Spill ports 10 and 11 could optionally be located elsewhere.

FIG. 2 also shows basket 12 located within vent 6. Basket 12 has a plurality of perforations 13 that are of a size to retard the passage of large particulate from the oxidizer section casing 2 into the fuel grain casing 3. Flow distributor 14, also known as a gasdistributing plug or stem, has a plurality of distribution orifices 15. Flow distributor 14 is intended to distribute the flow of oxygen from the propellant casing within the fuel casing so as to permit more even use of fuel. It is understood that flow distributor 14 could be used with basket 12 or independently thereof.

Figure 3:
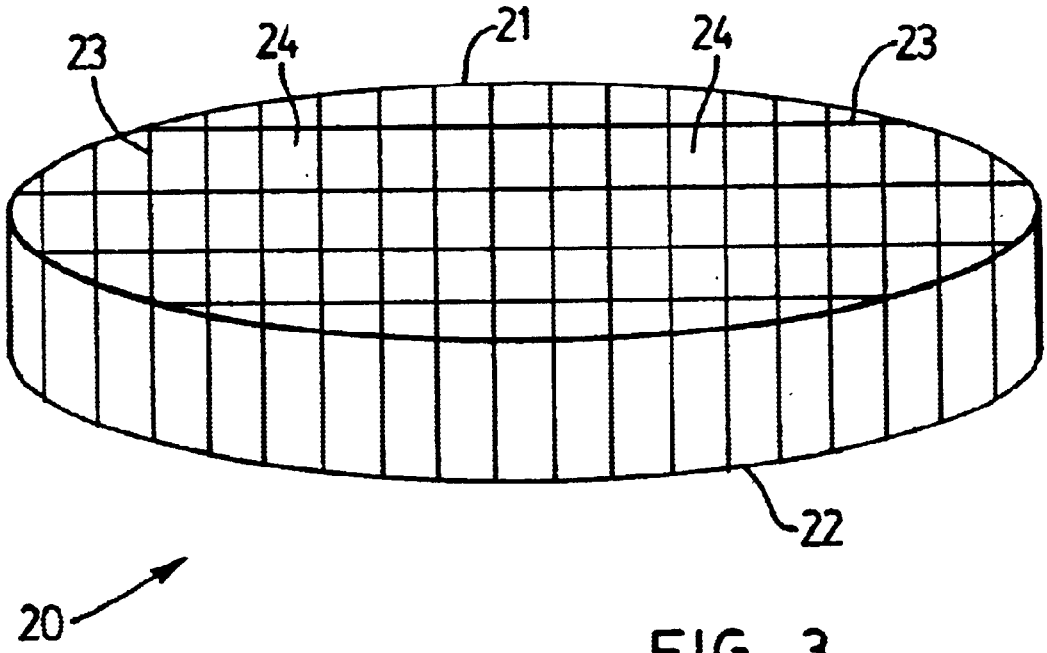
FIG. 3 is a schematic representation of a perspective view of a propellant grid.

FIG. 3 shows an oxidizer package, generally indicated by 20. Oxidizer package 20 has a top 21 and a bottom 22, which are preferably planar and parallel. Thus oxidizer package 20 is preferably a right cylinder of oxidizer material.

Figure 4:
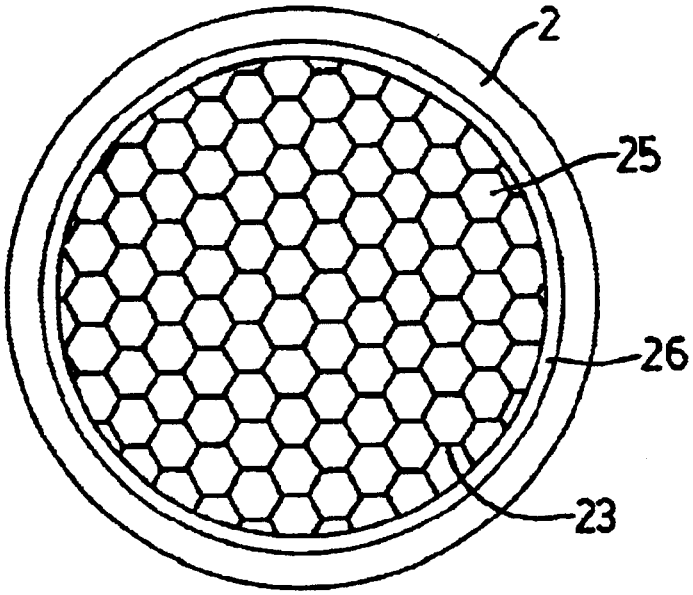
FIG. 4 is a schematic representation of a cross-section of a hybrid rocket showing a package of propellant.

FIG. 4 shows a cross-section of oxidizer section casing 2 having oxidizer package 20 therein. Oxidizer 25 is within grid 23 and is in a plurality of columns perpendicular to the plane as viewed. Wrapping 26 is shown between oxidizer 25 and casing 2. It is understood that the oxidizer package 20 should fit tightly within and optionally be bonded to oxidizer section casing 2, to prevent the flow of hot gases and burning around the perimeter during use.

Embodiments of the present invention will be particularly described herein with reference to the use of tubes of oxidizer in a matrix of ancillary compound in a package of oxidizer for a hybrid rocket. It is understood however that oxidizer could be used without ancillary compound. In addition, the tubes are one embodiment of ampoules, which also include spheres, capsules, pellets, tubes, coatings or other forms in which compounds are hermetically sealed from the oxidizer. The ampoules could be pressurized. Moreover, use of the ampoules may be made in solid fuel rockets to incorporate compounds that enhance the performance of the rocket. Such compounds may be liquid, solid or semi-solid.

FIG. 2 also shows basket 12 located within vent 6. Basket 12 has a plurality of perforations 13 that are of a size to retard the passage of large particulate from the oxidizer section casing 2 into the fuel grain casing 3. Flow distributor 14, also known as a gasdistributing plug or stem, has a plurality of distribution orifices 15. Flow distributor 14 is intended to distribute the flow of oxygen from the propellant casing within the fuel casing so as to permit more even use of fuel. It is understood that flow distributor 14 could be used with basket 12 or independently thereof.

FIG. 3 shows an oxidizer package, generally indicated by 20. Oxidizer package 20 has a top 21 and a bottom 22, which are preferably planar and parallel. Thus oxidizer package 20 is preferably a right cylinder of oxidizer material.

FIG. 4 shows a cross-section of oxidizer section casing 2 having oxidizer package 20 therein. Oxidizer 25 is within grid 23 and is in a plurality of columns perpendicular to the plane as viewed. Wrapping 26 is shown between oxidizer 25 and casing 2. It is understood that the oxidizer package 20 should fit tightly within and optionally be bonded to oxidizer section casing 2, to prevent the flow of hot gases and burning around the perimeter during use.

Embodiments of the present invention will be particularly described herein with reference to the use of tubes of oxidizer in a matrix of ancillary compound in a package of oxidizer for a hybrid rocket. It is understood however that oxidizer could be used without ancillary compound. In addition, the tubes are one embodiment of ampoules, which also include spheres, capsules, pellets, tubes, coatings or other forms in which compounds are hermetically sealed from the oxidizer. The ampoules could be pressurized. Moreover, use of the ampoules may be made in solid fuel rockets to incorporate compounds that enhance the performance of the rocket. Such compounds may be liquid, solid or semi-solid.

Oxidizer package 20 has a grid of structural and/or pyrotechnic material, 23, with the spaces 24 of the grid filled with oxidizer. It is preferred that the spaces 24 be volumetrically filled, i.e. such that there are no holes, voids, or porosity in the oxidizer. Thus, oxidizer package 20 is in the form of a plurality of columns of oxidizer, in a grid of pyrotechnic and/or structural material. The pyrotechnic material is preferably characterized by having a burn rate that is faster than the oxidizer. Thus, on ignition, grid 23 burns away more quickly, exposing the columns of oxidizer with space therebetween formerly occupied by the grid. This increases the surface area of oxidizer that is burning, leading to a greater flow rate of oxidizing gases. Oxidizer package 20 would normally be covered with sealing or wrapping material that would hermetically seal the oxidizer from moisture or other contamination or exposure.

FIG. 4 shows a cross-section of oxidizer section casing 2 having oxidizer package 20 therein. Oxidizer 25 is within grid 23 and is in a plurality of columns perpendicular to the plane as viewed. Wrapping 26 is shown between oxidizer 25 and casing 2. It is understood that the oxidizer package 20 should fit tightly within and optionally be bonded to oxidizer section casing 2, to prevent the flow of hot gases and burning around the perimeter during use.

Embodiments of the present invention will be particularly described herein with reference to the use of tubes of oxidizer in a matrix of ancillary compound in a package of oxidizer for a hybrid rocket. It is understood however that oxidizer could be used without ancillary compound. In addition, the tubes are one embodiment of ampoules, which also include spheres, capsules, pellets, tubes, coatings or other forms in which compounds are hermetically sealed from the oxidizer. The ampoules could be pressurized. Moreover, use of the ampoules may be made in solid fuel rockets to incorporate compounds that enhance the performance of the rocket. Such compounds may be liquid, solid or semi-solid.

A variety of compounds may be hermetically sealed in ampoules. In particular embodiments, the oxidizer is incorporated into ampoules, such that the oxidizer in the ampoules is located in a matrix of ancillary compound. However, the ampoules may contain other compounds, admixed with oxidizer or in separate ampoules. Such other compounds include compounds that are not otherwise readily incorporated into compositions of oxidizer, for reasons of mechanical or physical properties e.g. incorporation of the compound into the oxidizer would result in unacceptable physical properties of the oxidizer, such as brittleness, tensile strength, composition integrity, etc. The compounds also include compounds that are hygroscopic, react with oxidizer or other component of the matrix of the oxidizer composition e.g. metals, curing agent, binder, or the like, with consequent issues of toxicity, safety or composition integrity etc. Some reasons for use of ampoules may relate to factors encountered during processing and other manufacture of the oxidizer compositions. Other types of compounds or compositions have been discussed above. It is understood that the compounds in the ampoules would cause benefits to the performance of the oxidizer.

The invention is also described herein with reference to the preferred embodiment in which the oxidizer is in a package. In other embodiments, the package may be omitted, thereby providing an oxidizer system without packaging.

Figure 5A:
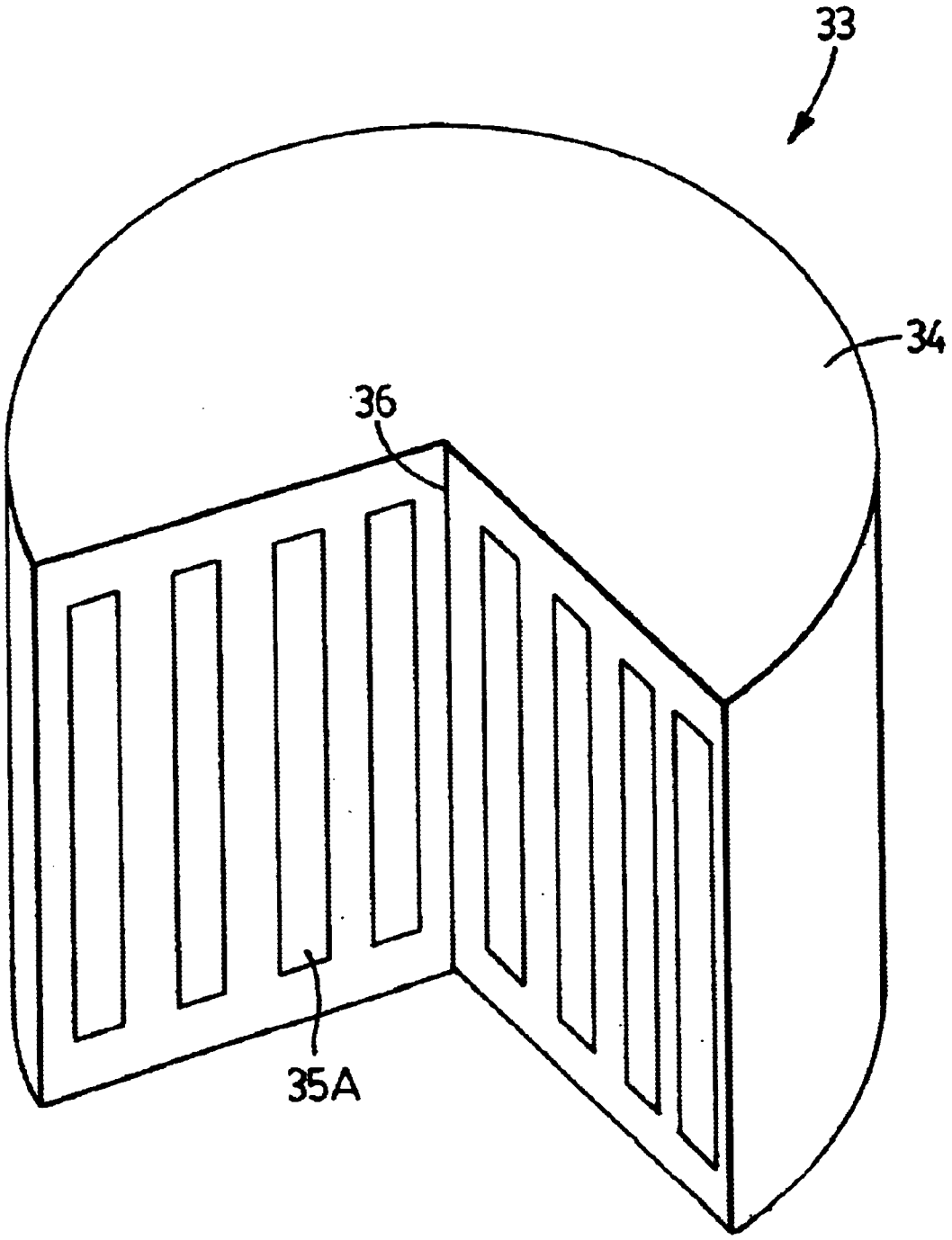
FIG. 5A is a schematic representation of a perspective view of a package with tubes, partly in section.
Figure 5B:
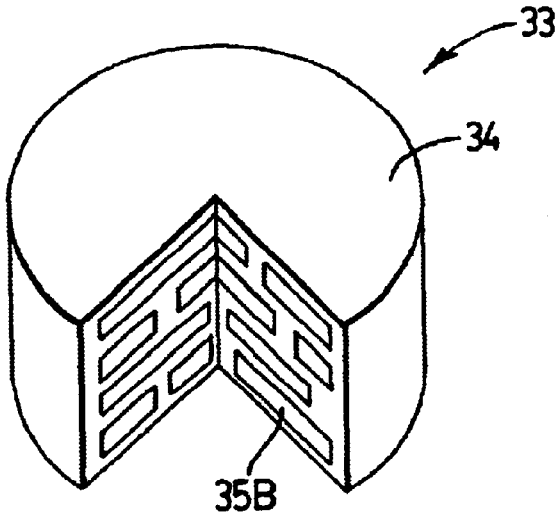
FIG. 5B is a schematic representation of a perspective view of a package with layers, partly in section.
Figure 5C:
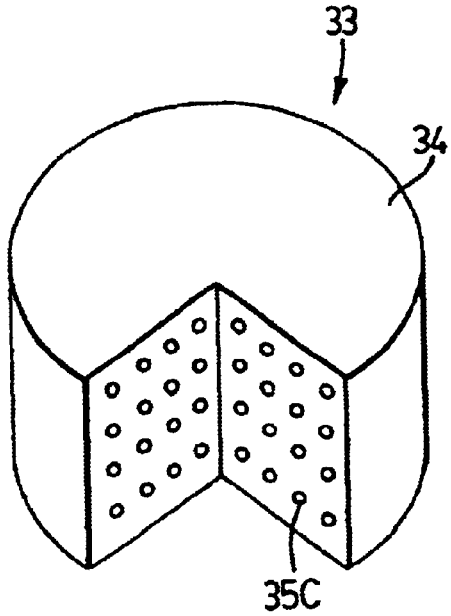
FIG. 5C is a schematic representation of a perspective view of a package with spheres, partly in section.
Figure 5D:
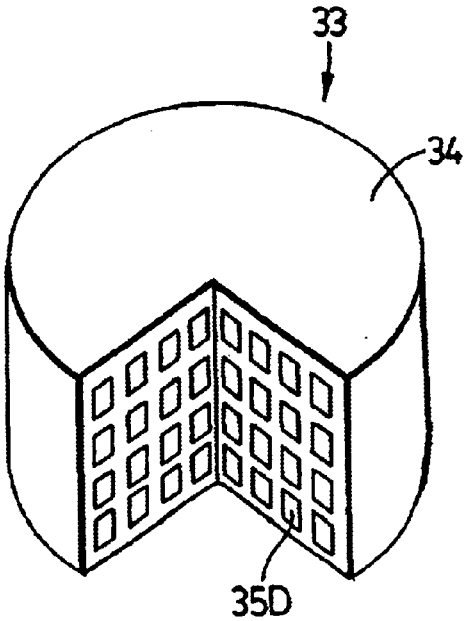
FIG. 5D is a schematic representation of a perspective view of a package with cylindrical ampoules, partly in section.

FIG. 5A shows an oxidizer package, generally indicated by 33. Oxidizer package 33 has a matrix 34 of oxidizer containing ancillary compound in the form of a right cylinder. It is understood that matrix 34 would have the oxidizer and ancillary compound in a binder, as described herein. Oxidizer package 33 is shown without any wrapping material. Matrix 34 has a plurality of tubes 35 A therein. In the embodiment shown, tubes 35 A are aligned parallel to axis 36 of oxidizer package 33, and are fully enveloped with matrix 34 of oxidizer and ancillary compound. It is understood that the tubes could be in other forms of sealed entities e.g. ampoules, packets or the like, preferably in a substantially uniform distribution. FIGS. 5B–5D show other examples. In FIG. 5B, the tubes have been replaced with layered ampoule sections, which could be radial overlapping layers or other layered shapes. In FIGS. 5C and 5D, the tubes have been replaced with spheres and cylindrical ampoules, respectively. The tubes, ampoules, layers etc would contain highly energetic or high performance oxidizer.

FIG. 6 shows six examples of cross-sections of oxidizer packages, some of which also show examples of burn patterns. It is understood that other examples of oxidizer packages and burn patterns could be used.

Figures 6A, 6B, 6C, 6D, 6E, 6F:
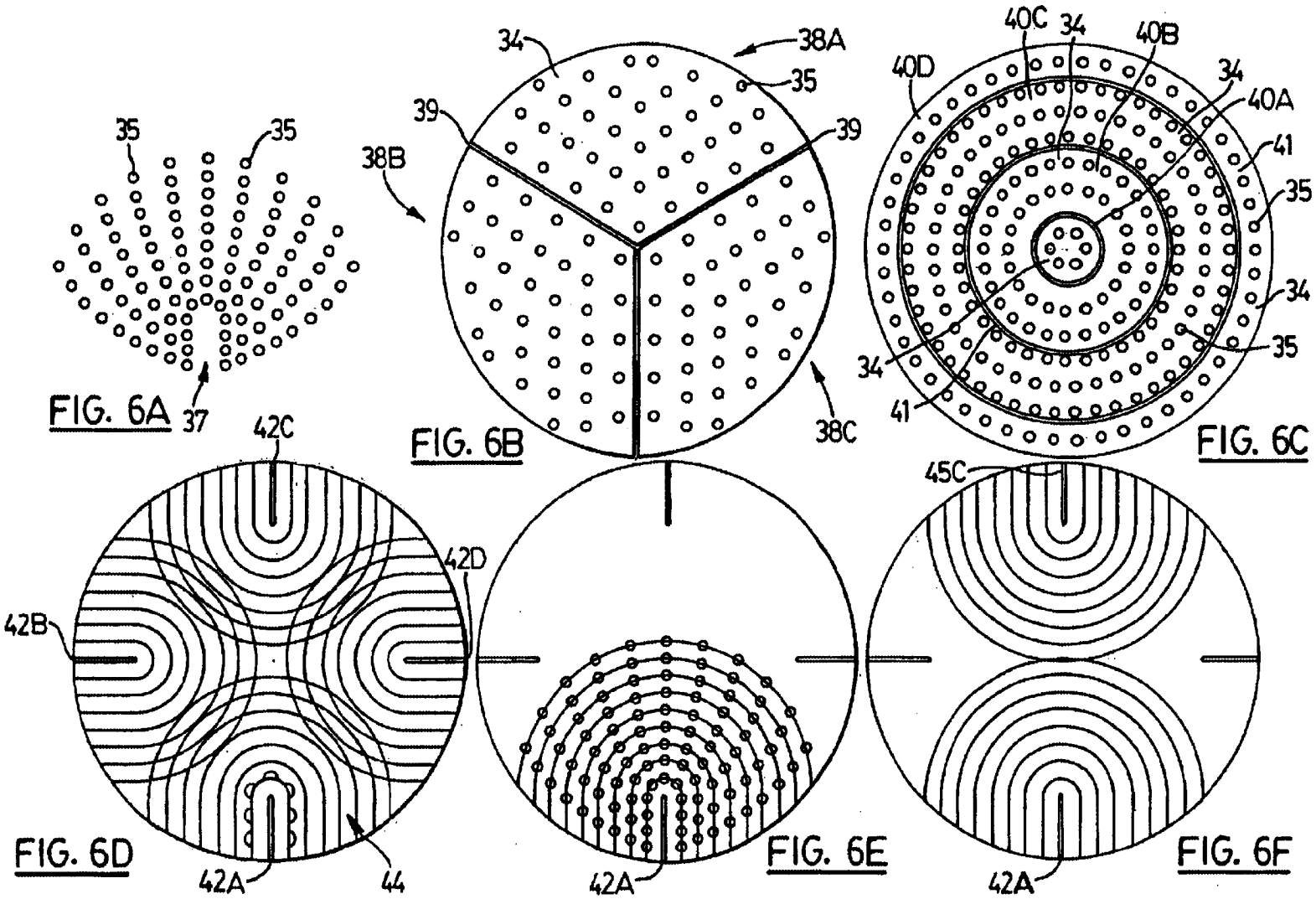
FIGS. 6A–6F are a schematic representation of a cross-section of embodiments of packages, some showing burn patterns.

FIG. 6A shows a plurality of tubes 35 arrayed in a pattern extending from a source of ignition 37 of the oxidizer package.

FIG. 6B shows a cylindrical oxidizer package having three sections 38A, 38B and 38C, each with matrix 34 and tubes 35. Sections 38A, 38B and 38C are separated by inhibitor material 39. Inhibitor material 39 is intended to permit ignition of one section of the oxidizer package e.g. section 38A, while preventing ignition of adjacent oxidizer packages 38B and 38C. In this manner, ignition of oxidizer in the oxidizer package may be carried out in a controlled maimer, with ignition of one, or of all of sections 38A, 38B and 38C at any one time.

FIG. 6C shows a different array of sections. Sections 40A, 40B, 40C and 40D are in concentric circles, each with matrix 34 and tubes 35. Sections 40A, 40B, 40C and 40D are separated by inhibitor material 41. One or more of sections 40A, 40B, 40C and 40D could be ignited at any one time, and it would be normal to do so from the centre of the oxidizer package.

FIG. 6D shows the embodiment with burn patterns 44 if ignition is simultaneously made at each of points of ignition 42A, 42B, 42C, and 42D.

FIG. 6E shows a burn pattern from a single ignition, at 42A.

FIG. 6F shows the burn pattern if ignition is at opposed points of ignition 42A and 45C.

Thus, it is to be understood that the oxidizer packages could be separated into sections e.g. semi-circular sections, tri-sections and quadrants. Any convenient number of sections could be used. Each section may be initiated separately or in any combination or sequence. In addition, more than one initiator may be used e.g. 2–4 initiators, as illustrated in FIG. 6.

Figure 7:
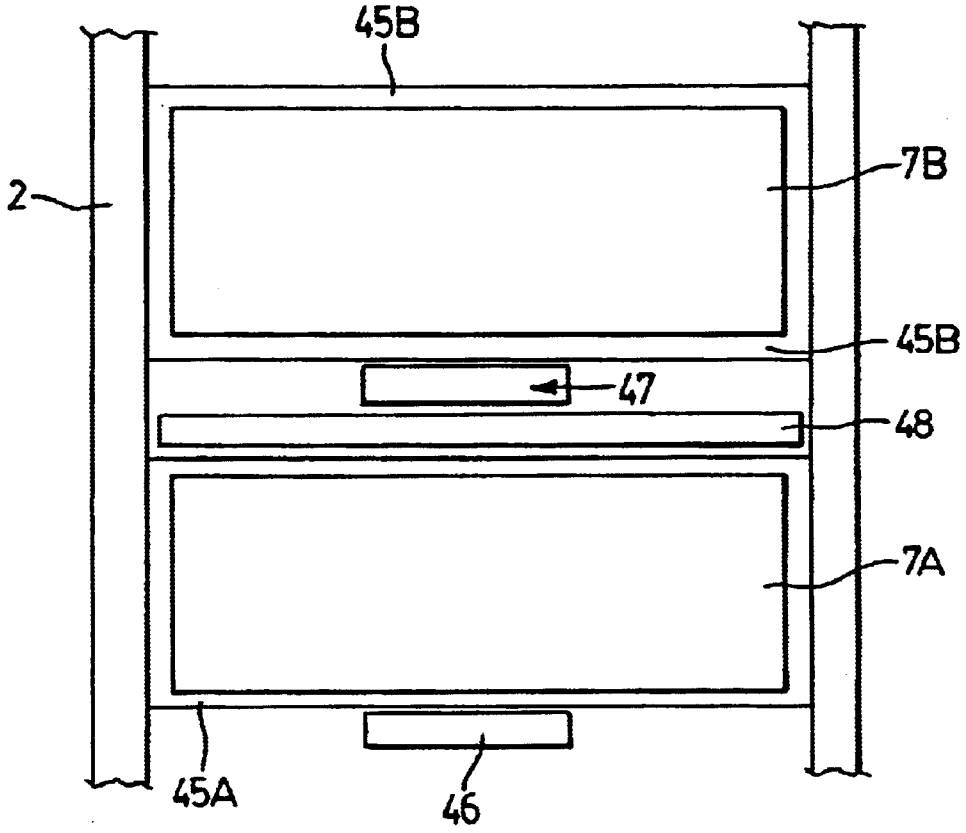
FIG. 7 is a schematic representation of a side view of packages of propellant in a rocket.

FIG. 7 shows a side view in section of oxidizer section casing 2 having oxidizer packages therein. Oxidizer section casing 2 has oxidizer packages 7A and 7B with other oxidizer packages not shown. Oxidizer package 7A has initiator 46 associated therewith, as well as wrapping/sealing material 45A. It is understood that the oxidizer package 7A could have initiator 46 within the sealed oxidizer package or separate therefrom. If separate, it is understood that the initiator would need to perforate the wrapping or sealing material so as to initiate the oxidizer.

Oxidizer package 7B is located above oxidizer package 7A and has initiator 47 associated therewith. Oxidizer package 7B is sealed by material 45B. Oxidizer package 7B is separated from oxidizer package 7A by inhibitor 48. Inhibitor 48 is intended to prevent the ignition of oxidizer package 7B by the combustion of oxidizer package 7A in an uncontrolled manner. It is intended that oxidizer package 7B would be ignited by initiator 47 at the appropriate timing.

It is understood that initiator 46 and 47 would have the appropriate electrical wiring, optical coupling, pyrotechnic coupling and timing, or other means to permit ignition of the respective oxidizer packages in the required sequence.

Figure 8:
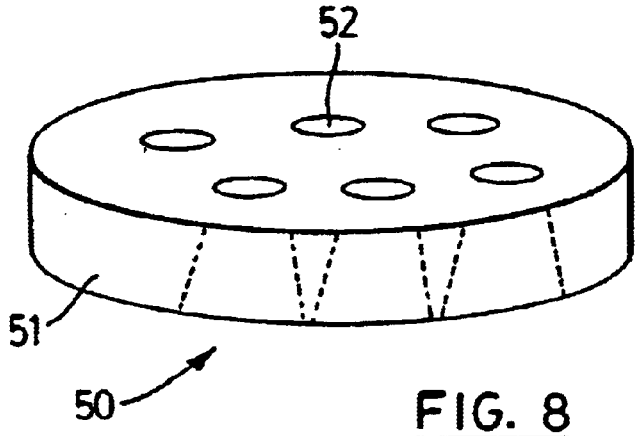
FIG. 8 is a schematic representation of an embodiment of an inhibitor disc.

FIG. 8 shows one example of an inhibitor shown as disc 50. Disc 50 would be formed of ceramic 51 or of any other suitable material that would not burn under conditions of use although it may ablate or char. Disc 50 has a plurality of holes 52, which would preferably be tapered holes with the larger dimension on the underside of disc 50. In this way, when oxidizer above disc 50 is initiated, plugging material in holes 52 would be forced downwards thereby permitting gases to pass through disc 50. However, combustion of oxidizer beneath disc 50 would not result in the material in holes 52 from being pushed upwards.

The oxidizer or oxidizer material, in combination with ancillary compound or separate therefrom, could consist of a single oxidizer compound or a blend of oxidizer compounds consolidated by pressure or melt-cast. Preferably, the oxidizer material would consist of an oxidizer compound or compounds in combination with binding (ancillary) material as used in solid propellant rocket motor systems. Examples of such binding materials are thermoset polymers such as HTPB, PBAN, -epoxies and others, thermoplastic polymers such as ethylene/vinyl acetate copolymer, or energetic polymers such as GAP, BAMO/AMMO or BAMO/NMMO. Nonetheless, binder systems and processing techniques therefor are known for solid propellant compositions, and such systems are applicable to this invention, as are any others that may be selected or required by compatibility, performance, or structural issues.

Examples of thermoplastic polymer propellant compositions and especially binders for such compositions are described in greater detail in Canadian Patent Application No. 2,243,245, published Jul. 15, 1998. For example, the binder could be polyethylene/vinyl acetate (EVA) or similar polymer, optionally cross-linked.

It is understood that the stoichiometry of oxidizer compositions used in this invention would be adjusted such that combustion of the composition results in the generation of gases containing an excess of free oxygen or other oxidizer elements. Thus, the oxidizer material will contain at least 80% by weight of oxidizer or oxidizers, and particularly greater than 90% by weight of oxidizer or oxidizers. The use of the ampoules permits an increase in the overall amount of oxidizer, while maintaining integrity of the compositions.

A variety of oxidizers known to the trade may be used, including but not limited to solid or semi-solid oxidizers such as ammonium perchlorate, ammonium nitrate, ammonium dinitramide, hydroxylammonium nitrate, hydroxylammonium perchlorate, hydrazinium nitroformate, nitronium perchlorate; liquid or semi-solid such as nitric acid, hydrogen peroxide. Alternatively, the oxidizer may be a so-called double based propellant i.e. nitrocellulose/nitroglycerine, optionally including ballistic modifiers, which may be alloyed with fluorine-containing polymers or other polymers to improve mechanical properties. The ratio of nitrocellulose (NC) to nitroglycerine (NG) may be varied to achieve a neutral or positive oxygen balance with increasing percentages of NG. With some ballistic modifiers e.g. copper and lead-based ballistic modifiers, double-based propellants may exhibit so-called plateau burning e.g. the propellant exhibits a substantially constant burn rate. Plateau burning, and reduced burn rates at higher pressures could act as a safety mechanism should the surface area of the propellant change e.g. due to voids, cracks or other problems. It is understood that other oxidizers could be used.

It is also known that modifiers may be used in the oxidizer material. Such modifiers are known as used in solid propellant systems. Examples of modifiers would be burn rate modifiers such as ferrocene or ferrocene derivatives, borohydrides, copper chromite, oxamide, oxides or fluorides of iron, chromium, copper, lithium, magnesium, and others; thermally-conductive burn rate modifiers such as silver wire or graphite whiskers; coupling agents/rheology modifiers such as titanates, zirconates, aluminates; bonding agents; opacifiers, stabilizers, metal deactivators, anti-oxidants, or other agents known to the trade to modify processing, performance, mechanical properties, storage stability, munitions sensitivity, or shelf life.

In addition to the above, the oxidizer material may contain one or more of the following: fuel additives, e.g. metal or non-metal powders, metal hydrides; energetic materials e.g. crystalline explosives such as HMX or RDX, liquid explosives such as TMETN or BTTN.

In embodiments of the invention, the propellant composition may be 90–94% oxidizer, 2.5–4.5% ancillary compounds, 0.5–1.0% burn rate modifiers, 0.5–1.0% energetic metals, 0.2–0.5% process modifiers and 0.2–0.4% curative agents in binder. The process modifiers and curative agents relate to the particular binder system that is used, as will be understood.

In preferred embodiments, the package of the present invention contains oxidizer and ancillary compound. The ancillary compound undergoes exothermic decomposition on decomposition of the oxidizer in the propellant system, with the exothermic decomposition being substantially without consumption of oxygen from the oxidizer. In particular, less than 10% of the oxidizer is consumed on the exothermic decomposition. In preferred embodiments, less than 5% of the oxidizer is consumed on the exothermic decomposition, and more preferably exothermic composition occurs without consumption of oxygen from the oxidizer.

The ancillary compound is selected from the group consisting of a fluoropolymer, a fluoroelastomer, and energetic polymer, a crystalline explosive and.a polymerized peroxide. Examples of the fluoropolymer are perfluorinated polymers and other fluorine polymers e.g. fluorinated hydrocarbons, including polymers available under the trademarks Teflon and Viton, and those known as KEL-F. The fluoropolymers may be used in an uncross-linked form, or cross-linked. For example, Viton polymers may be cross-linked with diamines e.g. Diak, bisphenol, dihydroxy compounds e.g. Viton curatives 20 and 30, and peroxides, as is known.

Examples of the fluoroelastomer are available under the trademark Viton or polyfluorinated polyols. Examples of the latter include polyperfluoro polyether polyols of the formula $HOCO_2CF(CF_3)O(C_2F_4)O[CF(CF_3)CF_2O]_nOCF(CF_3)CH_2OH$, where n=1–20. A preferred polyol has n=5.

Examples of the energetic polymer are GAP and BAMO.

Examples of crystalline explosives are TNT, RDX and HMX.

Examples of peroxide are hydrogen peroxide.

The amount of ancillary compound may be varied over a wide range e.g. from about 1% to 20% by weight and especially from about 5% to 15% by weight, based on the weight of the oxidizer.

The oxidizer may be selected from a wide variety of oxidizers, but some oxidizers will not be compatible in such compositions, as has been discussed herein. These oxidizers, which are generally highly energetic or high performance oxidizers, must be packaged separately, and this is done using the sealed ampoules. Thus in preferred embodiments, a highly A energetic oxidizer is physically separated from the oxidizer and ancillary compound by means of ampoules for example tubes. Thus, the high performance oxidizer is contained within a plurality of tubes, with the tubes being dispersed within the matrix of oxidizer and ancillary compound material. Examples of the highly energetic oxidizers include HAP, HAN, AND, HNF, nitronium perchlorate and $ClO_2$ compounds. For example, HNF has been shown to react with a number of common curatives used in solid propellant binder systems.

The ampoules may be formed from coated aluminum, especially in which the coated aluminum is selected from polymer coated aluminum, aluminum coated with a mixture of polymer and magnesium, and aluminum coated with a fluoroelastomer and magnesium. Alternatively, the ampoules are formed from pyroalloying metal foil or from laminates or sheet of magnesium and fluoropolymer. The ampoules may also be formed from polymers especially reactive polymers, examples of which include fluorinated polymers, engineering polymers e.g. nylon, nitrocellulose. Polymers containing fluorine undergo strong exothermic reactions with a variety of metals, especially aluminum and magnesium. Other materials may be used, provided that the materials effectively seal the contents of the ampoules from the matrix of oxidizer. Hydrocarbon polymers should not be used as they lconsume substantial amounts of oxygen during combustion.

The oxidizer package is in a wrapping or sealing material, and is preferably hermetically sealed but in some instances should be breathable, as will be understood. However, in some instances, it is preferred that the oxidizer packages be breathable i.e. that the oxidizer packages not be hermetically sealed. The nature of the oxidizer packages will depend on the composition within the oxidizer package. The oxidizer packages should be stackable in a column. If tubes are used, the tubes should be aligned parallel to the axis of the column.

Figure 9A:
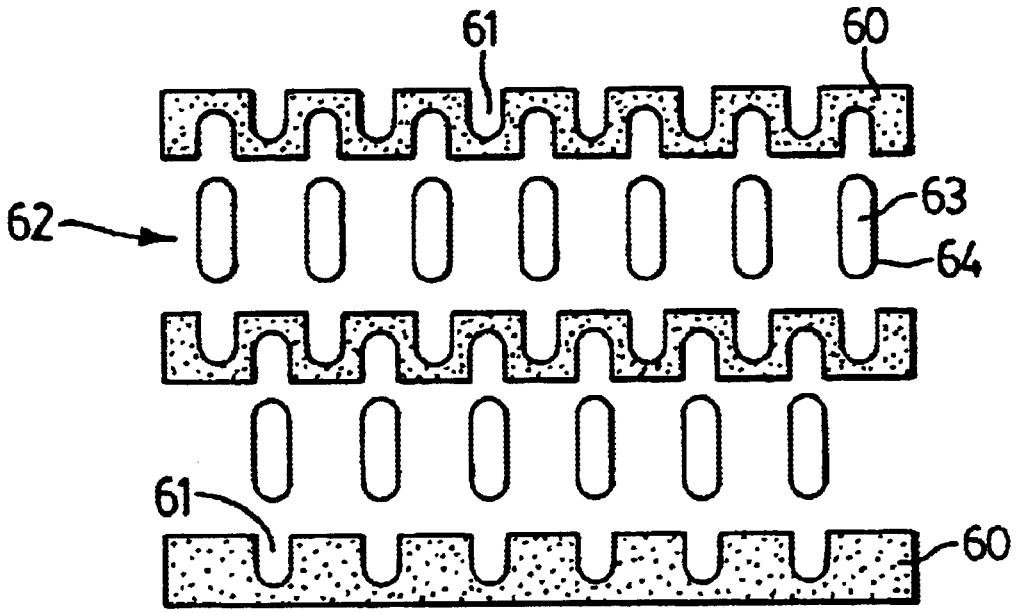
FIGS. 9A and 9B are schematic representations of exploded and assembled views of ampoules in a propellant matrix.
Figure 9B:
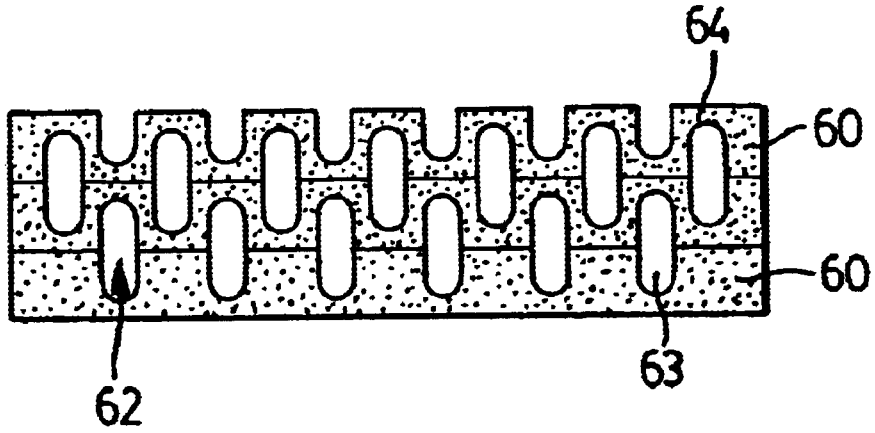

FIGS. 9A and 9B illustrates one example of an assembly of ampoules in a propellant matrix. In the exploded view of FIG. 9A, a matrix 60 of propellant is fabricated to have a multitude of recesses 61. The recesses 61 are cooperatively located so that each pair of recesses will accept an ampoule 62. Matrix 60 may be fabricated by a variety of techniques including casting, extrusion and the like. Ampoules 62 contain oxidizer 63 and have a shell 64 formed from, for example, fluoroelastomer-coated aluminum or magnesium.

FIG. 9B shows the assembled matrix with ampoules. The assembled matrix would typically have a casing (not shown).

The composition of oxidizer and ancillary compound may be manufactured using either hot or cold pressure consolidation techniques. In addition, the compositions of oxidizer and ancillary compound may be manufactured with or without use of vacuum. Examples of methods of manufacture are disclosed in the aforementioned Canadian Patent Application 2,243,245. The ampoules may be incorporated using such processes.

The compounds in the ampoules may be in liquid or solid form or semi-solid, including powders and crystalline forms. If powder or crystalline forms are used, the interstices should be filled with a liquid that further enhances the performance of oxidizer.

The ampoules should be incorporated into the matrix of ancillary compound in a uniform, consistent or patterned manner. This permits a degree of predictability to the oxidizer system. However, it is understood that there may be limited control in the process of manufacture to achieve uniformity, consistency or patterns.

The present invention provides a propulsion system for a rocket. The propulsion system utilizes an oxidizer section containing a package or plurality of packages of oxidizer material. The packages of the present invention pennit ratios of oxygen to fuel in the rocket to be varied, by using different combinations of packages.

In embodiments, the packages consist of a plurality of columns of oxidizer material, with the columns being supported by a grid of a structural and/or pyrotechnic material. In a preferred embodiment, the grid is constructed of a pyrotechnic material that upon ignition of the face of the grid, the grid material bums more quickly than the oxidizer material thereby exposing the columns of oxidizer material for more rapid combustion.

The oxidizer material is normnally in the form of an admixture of oxidizer and binderand the grid is preferably a honeycomb. The oxidizer material is formulated such that the combustion products yield a net excess of oxygen or other oxidizer species. The oxidizer packages should have complete volumetric loading such that no voids, fissures, or other porosity exists.

The present invention provides a grid of a pyrotechnic material, with the grid having opposed planar faces and voids extending therethrough. Preferably, the voids are columns, especially columns that are square, rectangular, hexagonal, or circular in cross-section. In particularly preferred embodiments of the invention, the grid is in the shape of a right cylinder.

In embodiments, the grid is coated aluminum or nitrocellulose. If the grid is formed of coated aluminum, then it is preferably polymer coated aluminum, aluminum coated with a mixture of polymer and magnesium, or aluminum coated with a fluoroelastomer and magnesium.

In further embodiments, the grid may be constructed of a pyroalloying metallic foil, or of a laminate of fluoropolymer sheet and magnesium foil, or of magnesium coated fluoropolymer sheet.

In further preferred embodiments, the oxidizer material is packaged in a wrapping or coating material, in which the oxidizer packages are hermetically sealed and stackable in a column.

In the rocket of the invention, the oxidizer packages are preferably separated by an inhibitor layer, each oxidizer package having an ignition system. The rocket would normally have a plurality of packages of oxidizer material in a stacked column.

The oxidizer section of the rocket would normally contain a vent to allow oxidizing gases to flow from the oxidizer section into the fuel grain section. The vent may have a pressure-activated control valve. The oxidizer section may contain a structure for preventing large particulate matter to flow into the fuel grain section. This structure could consist of a perforated basket incorporated into the vent assembly, with perforations of a size to control the flow of particulate matter into the fuel grain. Other means include a filter screen located downstream of the oxidizer packages consisting of a porous material capable of functioning in a high temperature oxidizing environment, such as sintered metal or ceramic, or foamed ceramics.

The vent may also incorporate a gas-distributing plug or stem therein, the plug or stem extending into the fuel grain section to effect distribution of the oxidizing gases.

The rocket may also contain spill ports/intakes for the entry of ambient air as sole or supplemental air. These could be located in the oxidizer section, or in the fuel grain section. The purpose of these ports would be to admit ambient air, particularly ambient oxygen, into the rocket either to supplement the oxidizing gases from the oxidizer material contained therein, or to supply the sole source of oxygen during selected periods of operation where the oxidizer section is inactive or has completed functioning. In the latter cases the rocket could be referred to as operating as a ramjet or scramjet.

The invention permits consolidation of high performance solid, semi-solid and/or liquid oxidizers into individual high density sealed packages. These oxidizer packages would be stored in the oxidizer section of the rocket and could be delivered at a controlled rate to the combustion chamber. Throttling and start/stop capabilities which are inherent characteristics and benefits of propulsion systems would be realized. Delivery of these packets could be accomplished by a number of means such as pyrotechnics, gas charge or either method in combination with acceleration forces. Geometry of the packages can be tailored to optimize packaging, structural efficiency, delivery systems and performance. Storage stability, safety and munitions sensitivity could be improved while realizing the performance benefits of these high performance oxidizers.

Propulsion systems offer a number of potential advantages over conventional solid propellant rocket propulsion systems especially when used in conjunction with high performance oxidizers. These advantages include increased bulk-loading potential plus deployment and long-term stability, as well as easily configurable thrust profiles including start/stop and throttling capability.

Packaging the oxidizer in hermetically-sealed packets minimizes environmental exposure, and offers the ability to utilize high performance oxidizers that normally present severe difficulties in solid propellant formulation. Hermetically sealed packages offer the potential for improved storage, deployment and long term stability.

Rocket systems using high performance oxidizers have commercial applications in military and non-military propulsion systems. The benefits of rocket propulsion could improve the flexibility and capabilities of these systems.

As noted above, the ampoules may also be used with solid fuel rockets e.g. rockets utilizing PBAN or HTPB, to provide additional compounds to enhance the performance of the rocket. As described above, the compounds in the ampoule would be compounds that cannot be incorporated into the solid fuel per se for reasons of physical properties, chemical properties or other characteristics, or which otherwise enhance performance of the rocket. Examples of compounds include beryllium hydrides and the like.

The present invention is illustrated by the following examples.

EXAMPLE I

A number of samples of potential propulsion systems were prepared using grids described herein. Hexagonal grids as illustrated in FIG. 4 were prepared using the following pyrotechnical material:

(i) fluoropolymer (Teflon™)—coated magnesium (ii) fluoropolymer (Viton™)—coated aluminum (iii) microfoamed GAP (iv) pyro-alloying metal foil e.g. aluminum—palladium (v) nitrocellulose The hexagonal grids had a thickness in the range of 10 to 1000 microns, with each hexagon of the grid being about 3 to 20 cm in diameter.

Examples of the grid were filled with compositions of 90–94% ammonium perchlorate containing an ancillary compound selected from Viton B, Viton B-50 and Viton B-200 fluoropolymers, low molecular weight fluoroelastomer viz. dipolymer of hexafluoropolymer and difluoroethane, optionally cross-linked with Diak diamine, double-based (NC/NG) propellant, GAP 5527 or PFPE polyol viz. the polyperfluoro polyether polyol described above.

Samples of the filled grids were successfully subjected to firing tests in a test motor.

EXAMPLE II

Samples of the grid in Example I were packaged in a paper/phenolic laminate tubular inhibitor sleeve and equipped with an initiator. The samples were successfully subjected to firing tests.

EXAMPLE III

For testing of samples, a test solid propellant motor was fabricated in a modular form. The motor had a casing that was 2.5 inches (6.3 cm) in diameter and was capable of receiving one, two or three ancillary grains/packets of 1.025 inches (2.60 cm) in length. The motor was typically used with an inhibitor plate as disclosed herein, and appropriate end closures. The motor was similar in design to that of FIG. 1, except that it was intended for laboratory testing.

The motor was successfully loaded and fired with samples fabricated according to the procedure of Example I on numerous occasions.

EXAMPLE IV

A propellant composition was formulated as follows:

| | Wt % |
|---|---|
| Ammonium perchlorate, spherical, 200 micron | 56.0 |
| Ammonium perchlorate, ground, 15 micron | 21.6 |
| GAP polyol | 12.7 |
| GAP plasticizer | 5.6 |
| Bonding agent | 0.046 |
| Antioxidant/metal deactivator | 0.10 |
| Diisocyanate curative | 1.6 |
| Superfine Iron oxide | 0.25 |
| Carbon black | 0.050 |
| Aluminum, spherical, 2 micron | 2.0 |

A grain was formed using the above propellant, with GAP enclosed in ampoules imbedded in the propellant.

Characterization firings were performed in a 1.5 inch (3.8 cm) micro-motor using single Bates grain with approximately 50 g propellant mass. A burn rate of 1.5 inches/second was achieved at 500 psia chamber pressure.

This example illustrates use of ampoules in propellants. The formulation was not optimized.

What is claimed is:

1. An oxidizer package for a propellant system for a motor in a rocket, the oxidizer package comprising:

an oxidizer material disposed in a matrix, the oxidizer material being contained in ampoules within the matrix; and an ignition system therefor, wherein the matrix comprises a material selected from the group consisting of an ancillary compound, a mixture of an oxidizer and an ancillary compound, and a pyrotechnic material, the ancillary compound undergoing exothermic decomposition substantially without consumption of oxygen from the oxidizer material.

2. The package of claim 1 in which the oxidizer material is a liquid, a solid or a semi-solid material.

3. The package of claim 1 in which the ampoules further contain carriers or perfonrmance enhancing compounds selected from the group consisting of a fluoropolymer, a fluoroelastomer, an energetic polymer, a non-energetic polymer, an energetic metal, a crystalline explosive, polymerized peroxide, a metal hydride and a double-base propellant.

4. The package of claim 1 in which the ampoules are in the form of at least one of spheres, capsules, pellets, rods and tubes.

5. The package of claim 1 in which the ampoules comprise a shell formed from at least one of coated aluminum, pyroalloying metal foil, a laminate or sheet of aluminum, a laminate or sheet of magnesium, an energetic polymer, a non-energetic polymer, nitrocellulose and a double-base propellant.

6. The package of claim 4 in which the ampoules comprise a shell formed from at least one of coated aluminum, pyroalloying metal foil, a laminate or sheet of aluminum, a laminate or sheet of magnesium, an energetic polymer, a non-energetic polymer, nitrocellulose and a double-base propellant.

7. The package of claim 5 in which the coated aluminum is selected from the group consisting of polymer-coated aluminum, aluminum coated with a mixture of polymer and magnesium, and aluminum coated with a fluoroelastomer and magnesium.

8. The package of claim 6 in which the coated aluminum is selected from the group consisting of polymer-coated aluminum, aluminum coated with a mixture of polymer and magnesium, and aluminum coated with a fluoroelastomer and magnesium.

9. The package of claim 1 in which the packages are stackable in a column.

10. The package of claim 1 in which the matrix is the ancillary compound.

11. The package of claim 10 in which the ancillary compound is selected from the group consisting of HTPB, PBAN, epoxy, thermoplastic polymer, GAP, BAMO/AMMO and BAMO/NMMO.

12. The package of claim 1 in which the matrix is polyethylene/vinyl acetate (EVA), optionally cross-linked.

13. The package of claim 1 in which the oxidizer is selected from ammonium perthlorate, ammonium nitrate, ammonium dinitramide, hydroxylammonium nitrate, hydroxylammonium perchlorate, hydrazinium nitroformate, nitronium perchlorate, nitric acid, hydrogen peroxide and nitrocellulose/nitroglycerine.

14. The package of claim 1 in which the matrix comprises 90–94% oxidizer, 2.5 –4.5% ancillary compounds, 0.5–1.0% burn rate modifiers, 0.5–1.0% energetic metals, 0.2–0.5% process-modifiers and 0.2–0.4% curative agents.

15. The package of claim 1 in which there is more than one initiator.

16. The package of claim 15 in which there are 2 to 4 initiators.

17. The package of claim 4 in which the ampoules comprise a shell formed from the pyrotechnic material.

* * * * *